US006692315B1

(12) United States Patent
Soumillon et al.

(10) Patent No.: US 6,692,315 B1
(45) Date of Patent: Feb. 17, 2004

(54) FUSE HOLDER AND FUSE HOLDER CLIP

(75) Inventors: Olivier Soumillon, Torchefelon (FR); Dominique Fiorini, Meyzieu (FR); Alain Morel, Genas (FR)

(73) Assignee: Ferraz Shawmut, Villeurbanne (FR)

( * ) Notice: Subject to any disclaimer, the term of this patent is extended or adjusted under 35 U.S.C. 154(b) by 0 days.

(21) Appl. No.: 10/009,525

(22) PCT Filed: Jun. 19, 2000

(86) PCT No.: PCT/FR00/01690

§ 371 (c)(1),
(2), (4) Date: Feb. 22, 2002

(87) PCT Pub. No.: WO00/79555

PCT Pub. Date: Dec. 28, 2000

(30) Foreign Application Priority Data

Jun. 17, 1999 (FR) ..... 99 07891

(51) Int. Cl.[7] ..... H01R 4/48
(52) U.S. Cl. ..... 439/830
(58) Field of Search ..... 439/830–833, 439/621, 622

(56) References Cited

U.S. PATENT DOCUMENTS

| | | | | |
|---|---|---|---|---|
| 1,950,557 A | | 3/1934 | Jackson | 439/830 |
| 2,096,413 A | | 10/1937 | Swartz et al. | 264/145 |
| 4,176,906 A | | 12/1979 | Urani | 439/830 |
| 4,472,018 A | * | 9/1984 | Urani | 439/830 |

FOREIGN PATENT DOCUMENTS

| | | |
|---|---|---|
| GB | 2096413 | 4/1981 |

* cited by examiner

*Primary Examiner*—Ross Gushi
(74) *Attorney, Agent, or Firm*—Ralph A. Dowell; Dowell & Dowell PC

(57) ABSTRACT

A fuse-holder clip including two lugs designed to define a space for receiving a fuse cartridge with circular cross-section. The lugs are folded along lines parallel to a central axis of the cartridge when the cartridge is placed in the clip such that each lug forms two electrical and mechanical lines of contact for engaging and supporting the cartridge with the two lines being globally parallel to the axis.

16 Claims, 6 Drawing Sheets

5
6
6a
X1
21h
β
22h
22g
22d
D22
22a
22f
22b
D21
21g
21d
α
C22
D6
21f
C21
22e
21e
21a
A22
21b
A21
22c
21c
e
22
E
21
2
1
3
P21
P
4
P22

FUSE HOLDER AND FUSE HOLDER CLIP

BACKGROUND OF THE INVENTION

1. Field of the Invention

The invention relates to a clip for a fuse-holder and to a fuse-holder equipped with at least one such clip.

2. Description of the Related Art

In the domain of the protection of electrical installations, it is known to use so-called cylindrical fuse cartridges, i.e. of which the two terminals or cartridges are cylindrical, these terminals or cartridges being provided to be received in clips, themselves connected to electrical lines. The clips of the known devices comprise rounded parts provided to substantially follow the shape of a part of the circumference of the cylindrical cartridge of a fuse. There is thus surface contact between the clips and the cartridge.

Furthermore, in order to withstand an effort of repulsion created in the event of an overintensity, between the cartridge of a fuse and the clip in which it is received, the standards provide that the force of abutment or of pressure of a clip on a fuse cartridge must be of the order of several tens of Newton. For example, in the case of a fuse of which the terminals have a diameter of 27 mm, the force of abutment must be greater than or equal to 45 Newton. Although such a force is useful when the fuse is in place in the clip, it opposes the positioning and extraction of the fuse in and from the clip, with the result that the efforts that an operator must exert on these occasions are intense, to the point of generating false manoeuvres. In this way, it is not rare that, when a fuse is extracted from a known clip, the effort to be exerted, which must overcome the frictions generated at the level of the contact surfaces, is so great that it induces a violent tearing of the fuse which "jumps" from its housing in the fuse-holder and drops onto the floor.

In addition, in the known devices, the contacts between the cylindrical cartridge of a fuse and the two lugs of a clip may be concentrated in two zones distributed on either side of the cartridge, with the result that the dimensioning of the clips must be provided, considering the fact that the breakdown current is divided into two at the level of each clip. This imposes the constitution of thick, therefore rigid, clips, and induces additional difficulties when a fuse is being positioned or extracted.

In the devices of the prior art, it is common to place a plurality of fuses in parallel, a trigger circuit being provided for this purpose. Taking into account the considerable forces which must be exerted on the fuse during installation or removal, the trigger circuit must be able to withstand a very considerable force which leads to it being overdimensioned, this increasing the cost of a fuse-holder.

SUMMARY OF THE INVENTION

It is a more particular object of the invention to overcome these drawbacks by proposing a clip of the afore-mentioned type in which a fuse cartridge of circular cross-section is efficiently held and which allows easy introduction and extraction of such a cartridge.

In this spirit, the invention relates to a clip for fuse-holder comprising two lugs designed to define between them a space for receiving a fuse cartridge with circular cross-section, characterized in that said lugs are folded in directions parallel to a central axis of the cartridge set in the clip such that they each form two electrical contact and mechanical support lines on the radial surface of this cartridge, these two lines being globally parallel to this axis.

Thanks to the invention, the contact between each of the lugs of the clip and the cartridge of a fuse is exerted along two lines, with the result that the efforts of friction which must be overcome when a fuse is being positioned or extracted, are generated solely between these lines and the outer radial surface of the cartridge. They are therefore less than in the case of surface contacts as obtained with the devices of the state of the art. Once the cartridge is in place in the clip, the latter is efficiently maintained thanks to the cooperation of the four lines of contact formed by the two clips. These four lines of contact also result in a division into four of the breakdown current, and even into three in the case of geometrical imperfection resulting in an abutment of the cartridge on three of the four lines of contact formed by the two clips. The maximum current transiting in each of the zones of contact is thus equal to a quarter or a third of the breakdown current of the fuse, which makes it possible electrically to dimension the clips as a function of this value, and not as a function of half the breakdown current as in the devices of the state of the art. The invention also makes it possible appropriately to dimension the trigger circuits provided for the combined manoeuvre of a plurality of fuses, since the efforts that they must withstand are substantially less than in the devices of the state of the art.

According to advantageous aspects of the invention, the clip incorporates one or more of the following characteristics:

- The traces of the two electrical contact and mechanical support lines in a plane perpendicular to the radial surface of the cartridge are included in a sector, centred on the trace of this central axis in this plane, of apex angle smaller than 30°. In particular, this apex angle may be provided to be included between 20 and 28°, preferably of the order of 24°. Thanks to this construction, the two electrical contact and mechanical support lines formed on each lug are relatively close to one another and the line character of the contact may be guaranteed insofar as the outer radial surface of the cartridge cannot penetrate between these lines to the point of generating a surface contact.
- Each lug comprises, between the lines of contact, a zone deformed outwardly with respect to a principal plane of the lug. This construction makes it possible to produce the two lines of contact in particularly simple manner. The deformed zone advantageously comprises two surfaces inclined with respect to the principal plane of each lug and with respect to one another. In that case, the apex angle of this deformed zone, which is defined by the two inclined surfaces, is advantageously included between 80 and 100°, preferably of the order of 90°.
- The ends of the lugs are divergent with respect to a median axis of the clip. The angle of divergence of these ends may be provided to be included between 16 and 24°, preferably of the order of 20°. Thanks to this arrangement, the ends of the lugs form a cone for slide during introduction of the cartridge of the fuse in the clip, hence a progressivity of the effort that the operator must exert for positioning the cartridge, such progressivity being felt by the user as an additional comfort. Moreover, the flared ends assist the movement of extraction of the fuse cartridge as they exert on the cartridge an elastic effort of ejection with respect to the clip. The lugs of the clip of the invention thus work both in flexion and in friction during the movements of positioning and of extraction of the fuse.

An outer holding spring is provided in abutment on the lugs of the clip at the level of the outwardly deformed zones, with respect to a principal plane of each lug, these zones being defined between the lines of contact. This outer spring ensures the effort of axial clamping of the fuse cartridge when the latter is in place in the clip.

The invention also relates to a fuse-holder equipped with at least one clip as described hereinabove. Such a fuse-holder is easier to manipulate, while remaining reliable and of moderate cost.

BRIEF DESCRIPTION OF THE DRAWINGS

The invention will be more readily understood and other advantages thereof will appear more clearly in the light of the following description of an embodiment of a clip for fuse-holder and of a fuse-holder in accordance with its principle, given solely by way of example and made with reference to the accompanying drawings, in which.

DESCRIPTION OF THE PREFERRED EMBODIMENT

Figure 4:
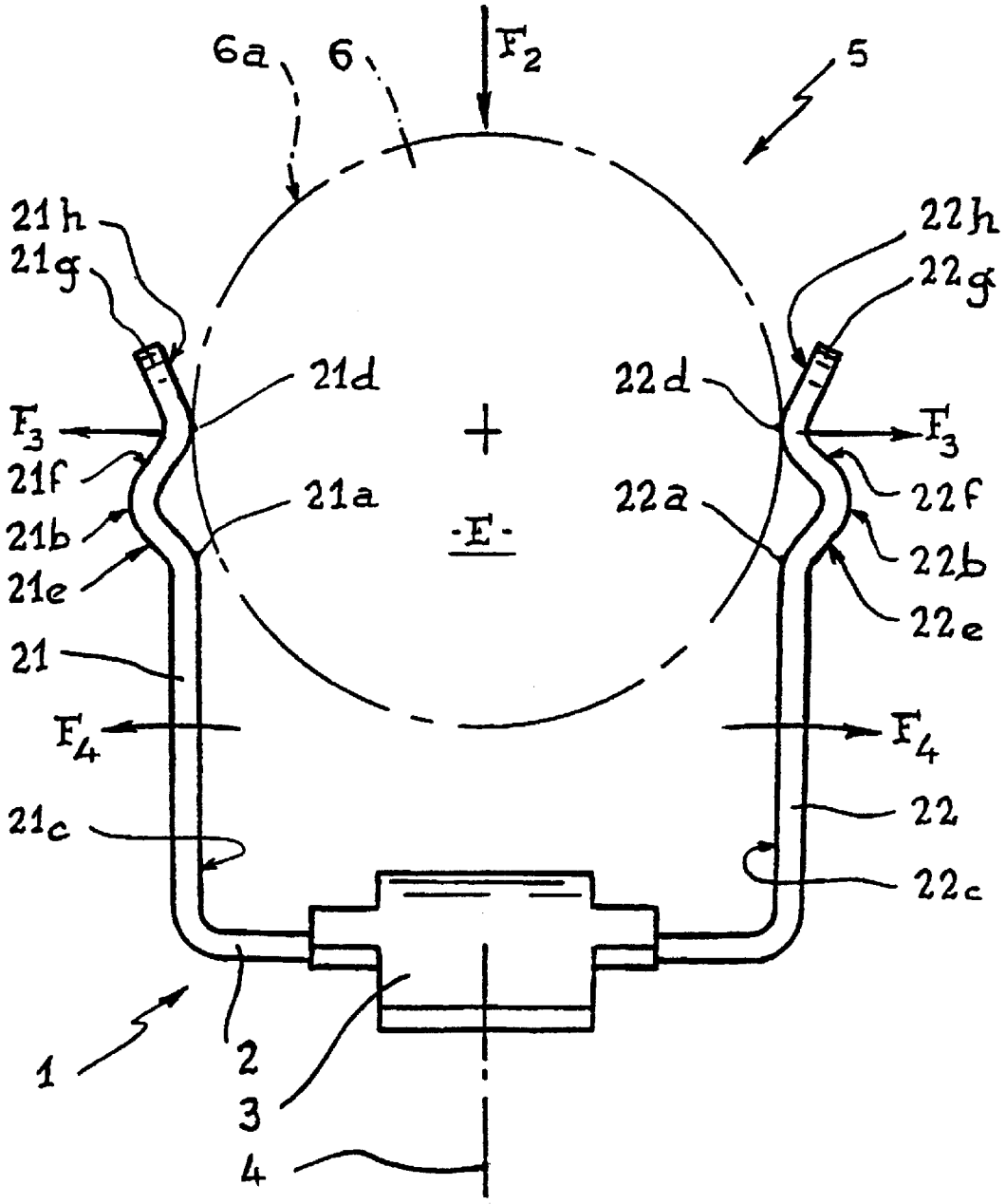
FIG. 4 is a view similar to FIG. 2 while the cartridge is in a second step of introduction in the clip.
Figure 5:
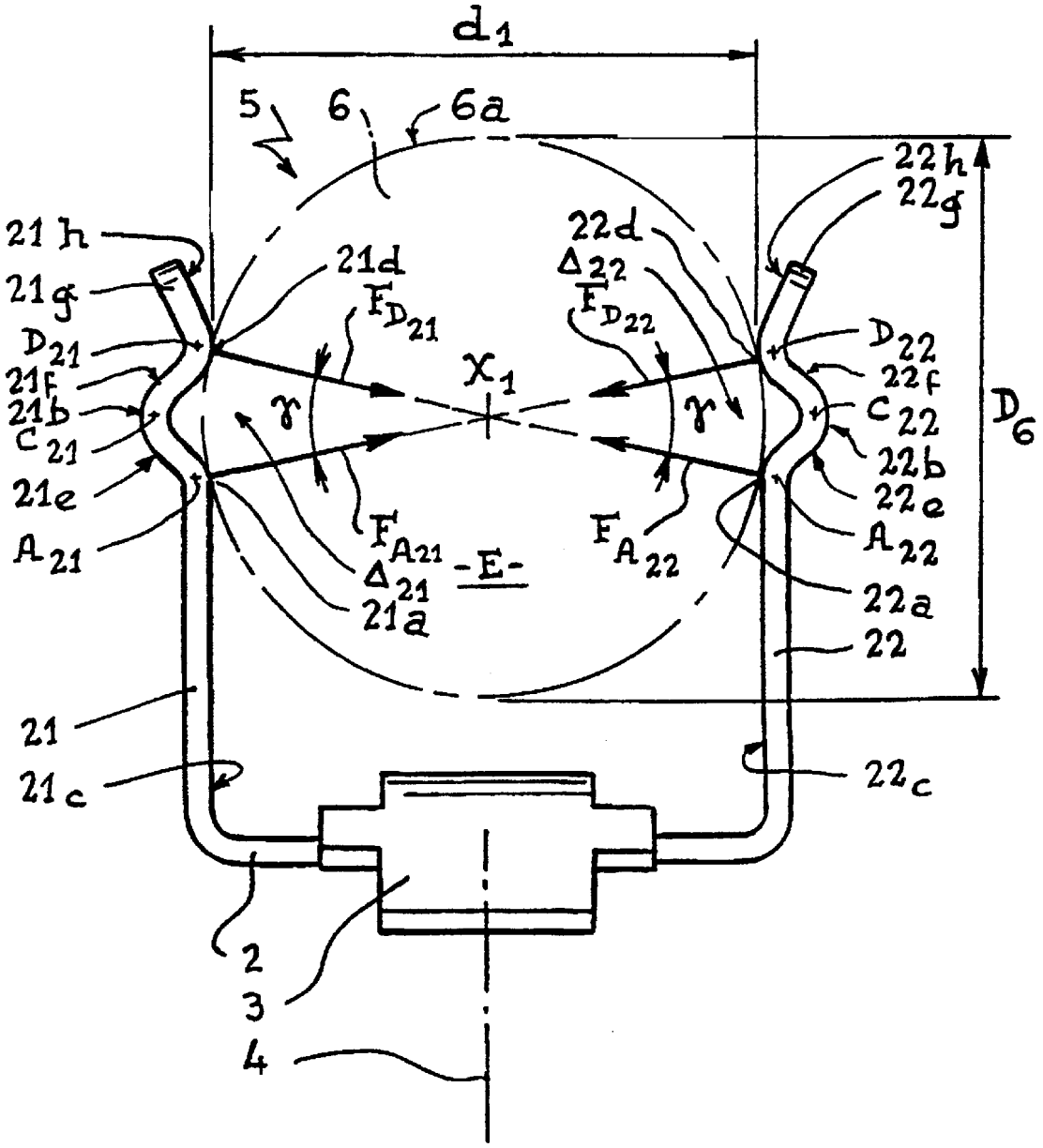
FIG. 5 is a view similar to FIG. 2 while the cartridge is in place in the clip.
Figure 6:
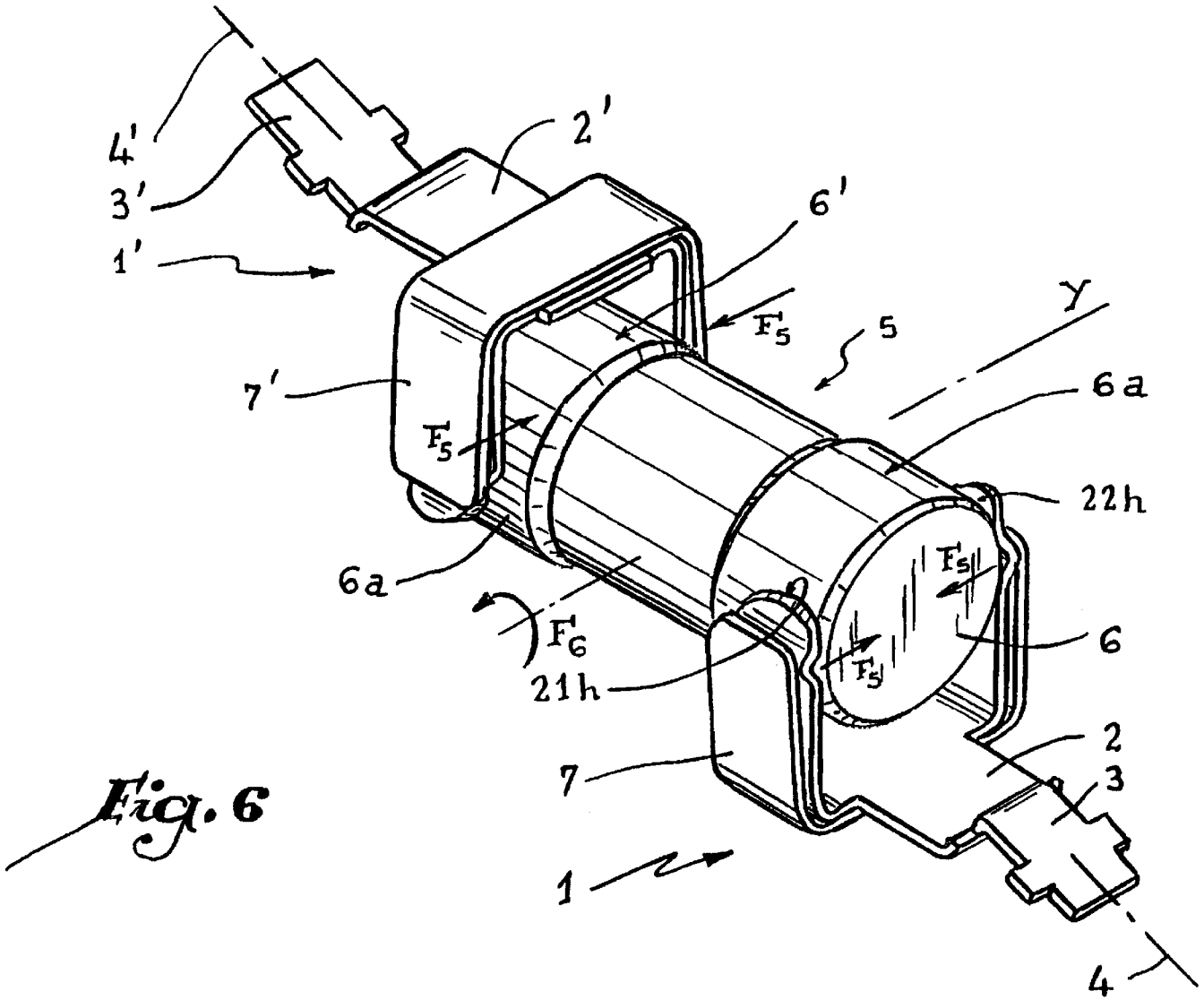
FIG. 6 is a partial view in perspective of a fuse-holder according to the invention.

The clip 1 visible in FIGS. 1 to 6 comprises a base 2 extending in a tongue 3 intended to be connected to an electrical conductor 4 schematized by an axis line and belonging to a line having to be connected to a fuse 5 represented in dashed-and-dotted lines in FIGS. 1 to 5 and in solid lines in FIG. 6.

The base 2 extends in two lugs 21 and 22 which extend in a direction substantially perpendicular to the base 2 and define therebetween a space E for receiving a cylindrical cartridge 6 forming one of the end terminals of the fuse 5.

Figure 1:
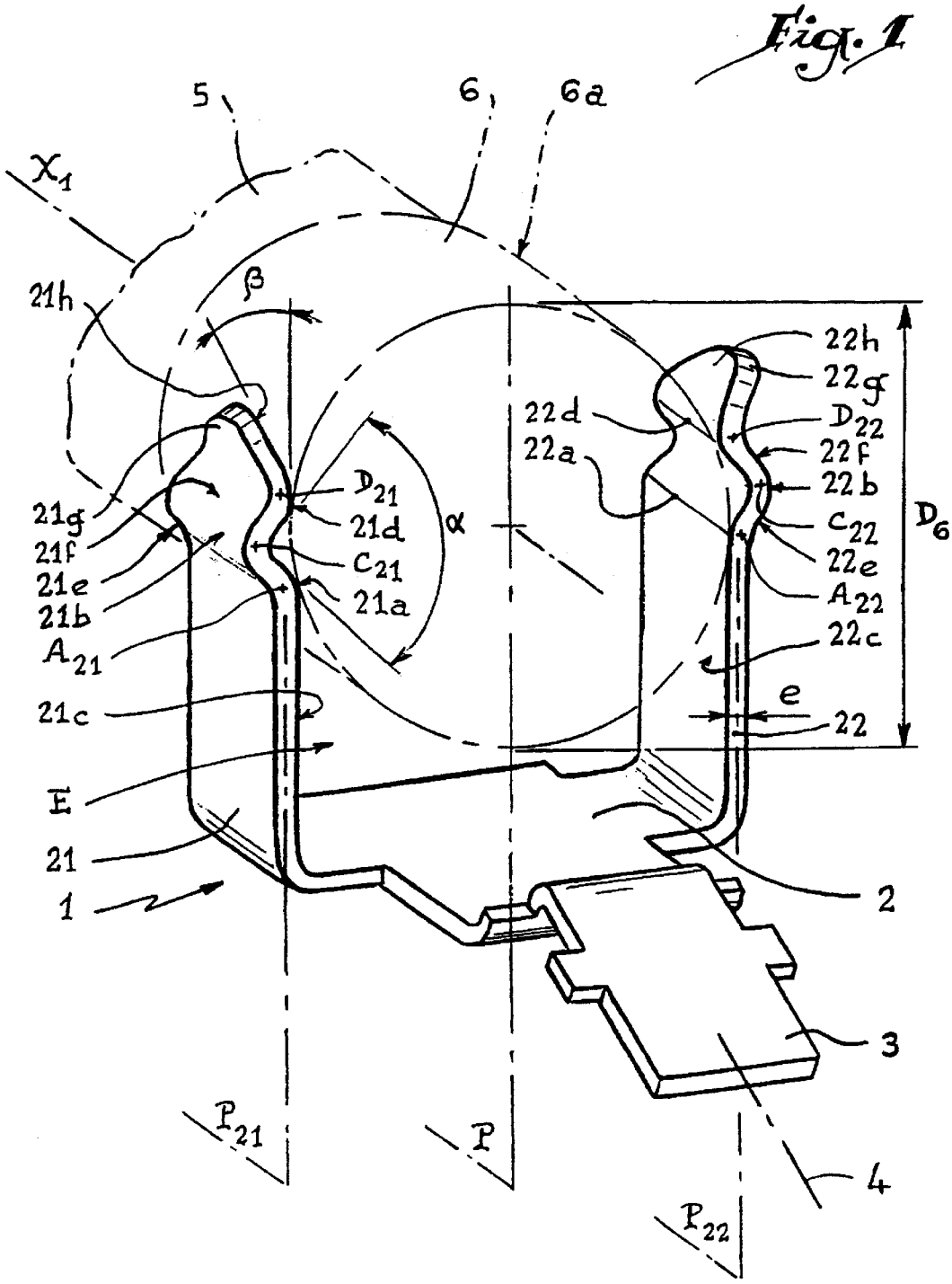
FIG. 1 is a view in perspective of a clip according to the invention.
Figure 2:
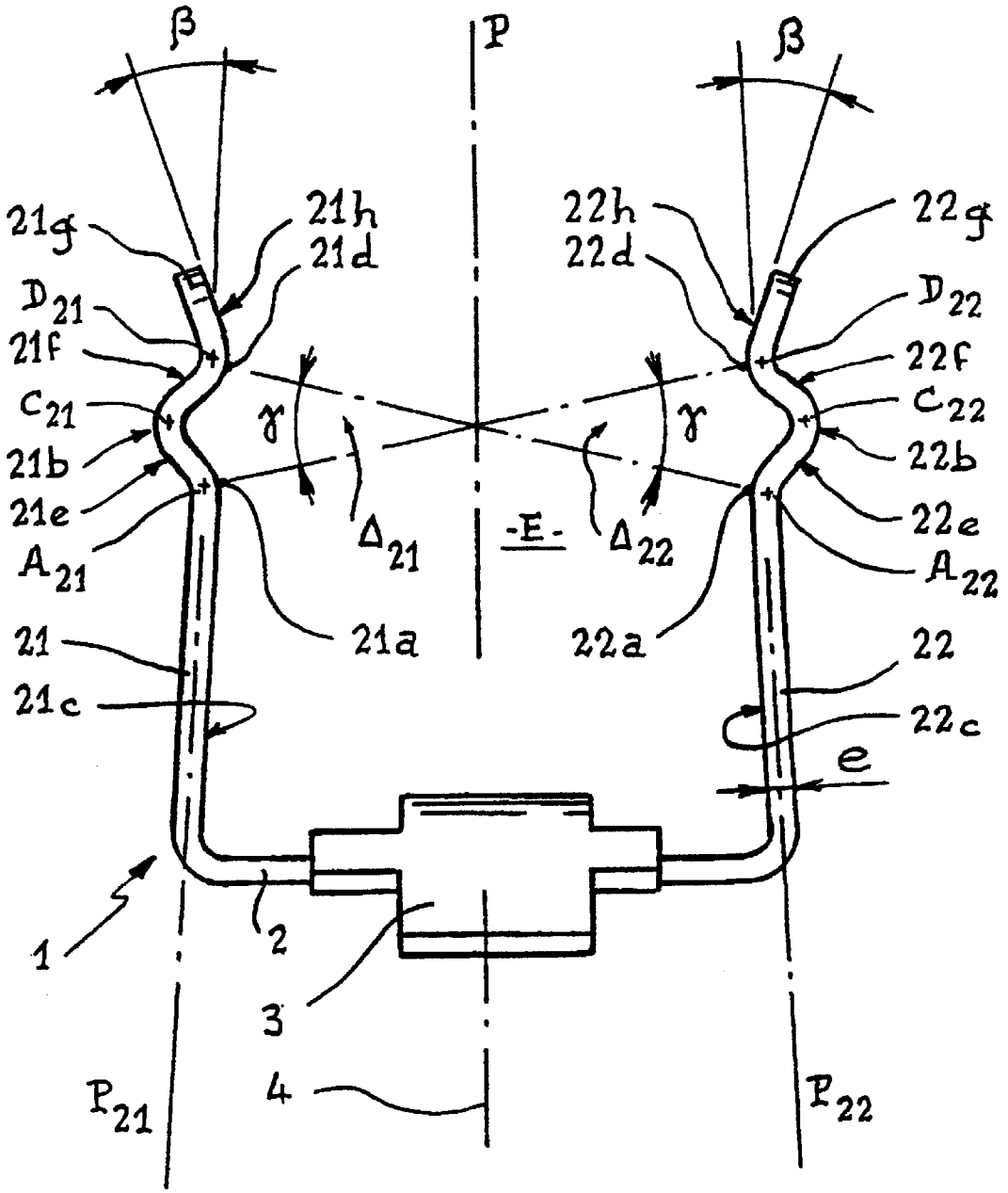
FIG. 2 is a front view of the clip of FIG. 1 at rest.

$X_1$ denotes the axis of symmetry of the cartridge 6, this axis $X_1$ being disposed in a median plane P of the space E when the cartridge 6 is in place in the clip 1, as shown in FIGS. 1 and 5. $D_6$ denotes the diameter of the cartridge 6.

$P_{12}$ denotes a plane substantially parallel to the plane P which constitutes a central plane of the lug 21 in its lower part. In the same way, $P_{22}$ denotes an equivalent plane for the lug 22.

According to the invention, the lug 21 is folded towards the outside of the plane $P_{21}$ with respect to the space E, about an axis $A_{21}$ substantially parallel to axis $X_1$ in the configuration of FIGS. 1 and 5. From the axis $A_{21}$, the lug 21 forms a zone 21*b* outwardly deformed with respect to the plane $P_{21}$ and which is concave in the direction of the space E as it is folded, about a second axis $C_{21}$ parallel to axis $A_{21}$, and in an opposite direction. The lug 21 is also folded along an axis $D_{21}$ parallel to axis $A_{21}$ and approximately included in the plane $P_{21}$. 21*e* and 21*f* respectively denote the surfaces defined between the axes $A_{21}$ and $C_{21}$, on the one hand, $C_{21}$ and $D_{21}$, on the other hand. The zone 21*b* is formed by surfaces 21*e* and 21*f*.

Beyond line 21*d*, the lug 21 extends in an end 21*g* folded towards the outside of the plane $P_{21}$.

$\alpha$ denotes the angle at the apex of the zone 21*b* in the plane of FIGS. 2 to 5 and $\beta$ the angle of inclination towards the outside of the end 21*g* of the lug 21, i.e. its angle of divergence with respect to plane P.

In the same way, the lug 22 is folded about axes $A_{22}$, $C_{22}$ and $D_{22}$ parallel to axes $A_{21}$, $C_{21}$ and $D_{21}$ and comprises two surfaces 22*e* and 22*f* extending to the outside of the plane $P_{22}$ with respect to the space E and defining a zone 22*b* deformed outwardly, between the axes $A_{22}$ and $D_{22}$. As before, the end 22*g* of the lug 22 is folded towards the outside with respect to the plane $P_{22}$.

As is more particularly visible in FIG. 5, when the cartridge 6 is in place in the clip 1, there are formed, on the inner surface of the lugs 21 and 22 turned towards space E and respectively at the level of axes $A_{21}$, $D_{21}$, $A_{22}$ and $D_{22}$, four electrical contact and mechanical support lines 21*a*, 21*d*, 22*a* and 22*d* between the lugs 21 and 22 and the outer radial surface 6*a* of the cartridge 6, these contact lines being substantially parallel to axis $X_1$.

In this way, and as is more particularly visible in FIG. 5, the effort of elastic abutment of the clip 1 on the surface 6*a* is decomposed into four elementary efforts $F_{A21}$, $F_{D21}$, $F_{A22}$ and $F_{D22}$, these efforts being substantially directed towards axis $X_1$.

In practice, the lines 21*a* and 22*a* are formed by the generatrices of the inner faces of the lugs 21 and 22 at the level of the axes $A_{21}$ and $A_{22}$, these generatrices being respectively defined at the join between the inner face of each lug 21 or 22 in its part 21*c* or 22*c* parallel to the plane $P_{21}$ or $P_{22}$ and the surface 21*e* or 22*e*. The lines 21*d* and 22*d* are formed by the generatrices of the inner faces of the lugs 21 and 22 at the level of the axes $D_{21}$ and $D_{22}$, these generatrices being respectively defined at the join of the inner faces of the surfaces 21*f* and 21*g* or 22*f* and 22*g*.

In the plane of FIGS. 2 to 5, the traces of the lines 21*a*, 22*a*, 21*d* and 22*d* are included in two angular sectors $\Delta_{21}$ and $\Delta_{22}$ of which $\gamma$ denotes the angle at the apex. The angle $\gamma$ is of the order of 24°, this value giving satisfactory results over a range included between 20 and 28°.

This relatively low angle value $\gamma$ corresponds to the fact that the lugs 21 and 22 are elatively little deformed in flexion when the cartridge 6 is being positioned and extracted. The efforts to be overcome therefore conserve a relatively low value, hence a comfort of use when the fuse 5 is being positioned and extracted.

Thanks to this arrangement, the lines of contact 21*a*, 22*a*, 21*d* and 22*d* are sufficiently close to one another for the surface 6*a* of the cartridge 6 not to risk penetrating inside the zones 21 and 22*b* to the point of a surface contact occurring between this surface 6*a* and the inner surface of the zones 21*b* and 22*b*. In other words, the geometry of the lugs 21 and 22 ensures a double line contact between these lugs and the cartridge 6, including in the case of slight dimensional defect of the clip 1 or of the cartridge 6.

Thanks to the invention, the maximum current capable of transiting between the fuse 5 and the conductor 4 is divided into four at the level of lines 21*a*, 22*a*, 21*d* and 22*d*. In the case of geometrical defect of the cartridge 6, one of the afore-mentioned lines is not necessarily in contact with the surface 6*a*, hold being, however, correctly ensured thanks to the other three lines of contact which define, with the cartridge 6, an isostatic system. In all cases, it may be considered that the maximum current transiting on a line of contact between the surface 6*a* and a lug 21 or 22 is at the most equal to one third, and even a quarter of the breakdown current of the fuse, with the result that the thickness e of the lugs 21 and 22 can be defined as a function of this parameter.

Figure 3:
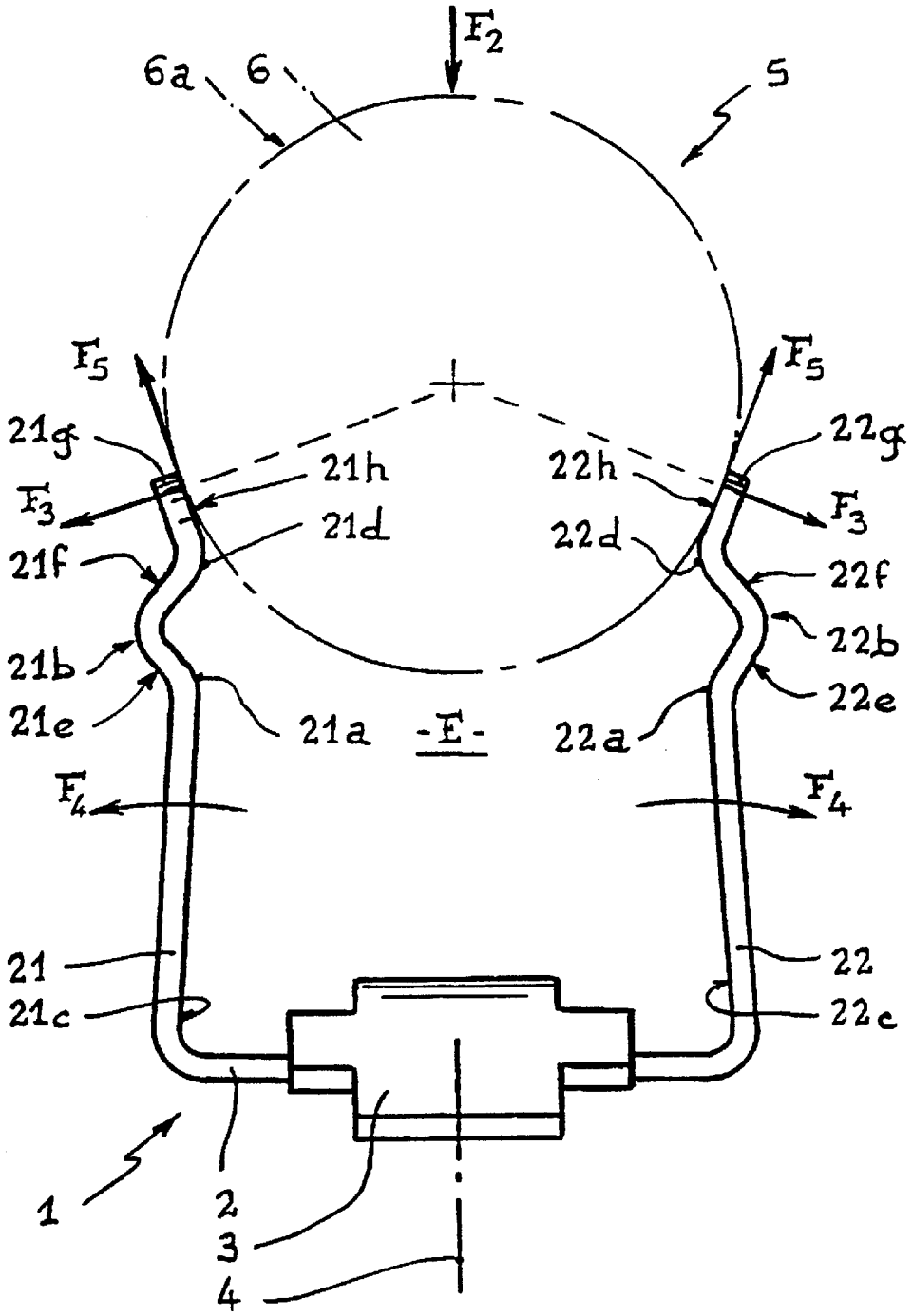
FIG. 3 is a view similar to FIG. 2 while a cartridge is in a first step of introduction in the clip.

The introduction of the cartridge 6 in the clip 2 is represented in FIGS. 3 and 4. At the beginning of the introduction, the outer radial surface 6*a* of the clip 6 rests against the inner surface of the ends 21*g* and 22*g* of the lugs 21 and 22. The thrust effort exerted by a user is represented by arrow $F_2$ and is transferred to the level of the zone of contact between the surface 6*a* and the ends 21*g* and 22*g*, as represented by arrows $F_3$. These efforts $F_3$ have the effect of bending the lugs 21 and 22, as represented by arrows $F_4$, while an effort of friction represented by arrow $F_5$ is generated at the level of the surfaces in contact, 6*a*, 21*g* and 22*g* in the configuration of FIG. 3. The lugs 21 and 22 therefore work both in flexion and in friction. In the configuration of FIG. 4, the effort $F_2$ that the user must exert essentially aims at moving the lugs 21 and 22 apart by flexion, as represented by arrows $F_4$, as the effort of friction is substantially reduced due to the essentially line contact which then occurs between the lines 21*d* and 22*d* and the surface 6*a*. This effort is not much greater than the effort which must be exerted in the configuration of FIG. 3, even if the lugs 21 and 22 are more deflected.

The position of FIG. 5 is then attained, where the efforts $FD_{A21}$, $F_{D21}$, $F_{A22}$ and $F_{D22}$ exerted along the four lines 21*a*, 21*c*, 22*a* and 22*c* are directed towards axis $X_1$ and border the two sectors $\Delta_{21}$ and $\Delta_{22}$ with apex angles $\gamma$ in the plane of FIG. 5. The cartridge 6 is in that case firmly immobilized and this all the more so as a holding spring 7 may be employed, as represented in FIG. 6.

$d_1$ denotes the distance between the lines 21*a* and 22*a* on the one hand, 21*d* and 22*d* on the other hand, in the configuration of FIG. 5. Taking into account the relatively low value of the angle $\gamma$, the distance $d_1$ is slightly less than the diameter $D_6$, which corresponds to the fact that the lugs 21 and 22 are only slightly deformed in flexion when the cartridge 6 is being positioned.

When the fuse 5 is to be extracted, it suffices to exert thereon an effort in the direction opposite the effort $F_2$, the contacts between the surface 6*a* and the lines 21*a* and 22*a* in that case being eliminated, with the result that there remain solely the line contacts at the level of lines 21*d* and 22*d*, a movement being able to be generated without too great an effort, with the result that the fuse must not undergo efforts or accelerations that may result in it dropping outside the fuse-holder.

As shown in FIG. 6, two clips 1 and 1' may be used in a fuse-holder, being disposed, in opposition, at the level of the two cartridges 6 and 6' of a fuse 5. Each clip 1 or 1' is connected by a lug 3 or 3' to a conductor 4 or 4'. Each clip is associated with a spring 7 or 7', in the form of a clamp, provided to exert on the lugs 21 and 22 an effort $F_5$ of clamping of the cartridges 6 or 6'. The effort $F_5$ may be relatively great, in particular in order that the fuse-holder be in accordance with the standards in force, without hindering positioning and extraction of the fuse, as this effort $F_5$ is transmitted to the cartridges 6 and 6' by the line contact obtained at the level of lines 21*a*, 22*a*, 21*d* and 22*d*.

In the configuration of FIG. 6, the movement of introduction and of extraction of the fuse 5 in the clips 1 is a movement of pivoting about a transverse axis Y, this movement being represented by arrow $F_6$. Taking into account the direction of this movement and in order to limit the efforts of contact, the ends 21*g* and 22*g* each comprise a slantwise edge 21*h*, 22*h*.

We claim:

1. A clip for a fuse-holder for a fuse cartridge comprising; two lugs extending from a base and spaced to define a space for receiving a fuse cartridge therebetween with circular cross-section, said lugs (21, 22) being folded in directions ($A_{21}$, $C_{21}$, $D_{21}$, $A_{22}$, $C_{22}$, $D_{22}$) parallel to a central axis ($X_1$) of the cartridge when seated between said two lugs such that they have two electrical and mechanical spaced lines of contact (21*a*, 21*d*, 22*a*, 22*d*) for engaging and supporting a radial surface of the fuse cartridge in such a manner that portions of said lugs intermediate said spaced lines of contact are spaced outwardly from the radial surface of the fuse cartridge when the fuse cartridge is seated between said two lugs, said spaced lines of contact of said two lugs being parallel to and on opposite sides of the axis of the fuse cartridge when the fuse cartridge is positioned therebetween, and wherein traces of said two electrical and mechanical lines of contact (21*a*, 21*d*, 22*a*, 22*d*) in a plane perpendicular to the radial surface of the fuse cartridge when seated between said lugs are included in a sector which is centered on a trace or the central axis ($X_1$) in a sector plane, with an apex angle ($\gamma$) less than 30°.

2. The clip of claim 1, wherein said apex angle ($\gamma$) is included between 20° and 28°.

3. The clip of claim 2 wherein said apex angle($\gamma$)is approximately 24°.

4. The clip of claim 1 wherein ends (21*g*, 22*g*) of said lugs (21, 22) are divergent with respect to a median plane (P) of the clip.

5. The clip of claim 4, wherein an angle of divergence ($\beta$) of said ends (21*g*, 22*g*) is included between 16° and 24°.

6. The clip of claim 5 wherein said angle of divergence is approximately 20°.

7. The clip of claim 1 wherein each lug includes between said spaced lines of contact (21*a*, 21*d*, 22*a*, 22*d*) a zone (21*b*, 22*b*) deformed outwardly with respect to principal planes ($P_{21}$, $P_{22}$) of said lugs.

8. The clip of claim 7, wherein each said deformed zone (21*b*, 22*b*) includes two surfaces (21*e*, 21*f*, 22*d*, 22*f*) inclined with respect to said principal planes ($P_{21}$, $P_{22}$) and with respect to one another.

9. The clip of claim 8 including an outer holding spring (7) which is in abutment on said deformed zones (21*b*, 22*b*) with respect to said principal planes ($P_{21}$, $P_{22}$) of each of said lugs to thereby urge said lugs toward one another.

10. The clip of claim 8, wherein an apex angle ($\alpha$) of said deformed zones (21*b*, 22*b*) defined by said two inclined surfaces (21*e*, 21*f*, 22*e*, 22*f*) is included between 80° and 100°.

11. The clip of claim 10 wherein said apex angle ($\alpha$) is approximately 90°.

12. A clip for a fuse-holder for a fuse cartridge comprising; two lugs extending from a base and spaced to define a space for receiving a fuse cartridge therebetween with circular cross-section, said lugs (21, 22) being folded in directions ($A_{21}$, $C_{21}$, $D_{21}$, $A_{22}$, $C_{22}$, $D_{22}$) parallel to a central axis ($X_1$) of the cartridge when seated between said two lugs such that they have two electrical and mechanical spaced lines of contact (21*a*, 21*d*, 22*a*, 22*d*) for engaging and supporting a radial surface of the fuse cartridge in such a manner that portions of said lugs intermediate said spaced lines of contact are spaced outwardly from the radial surface of the fuse cartridge when the fuse cartridge is seated between said two lugs, and said spaced lines of contact of said two lugs being parallel to and on opposite sides of the axis of the fuse cartridge when the fuse cartridge is positioned therebetween, and each lug includes a generally planar portion extending generally perpendicularly from said base and defining a principal plane ($P_{21}$, $P_{22}$) of the lug, and each lug includes, between said spaced lines of contact (21*a*, 21*d*, 22*a*, 22*d*), a zone (21*b*, 22*b*) deformed outwardly with respect to the principal planes ($P_{21}$, $P_{22}$) of said lugs.

13. The clip of claim 12 including an outer holding spring (7) which is in abutment on said deformed zones (21*b*, 22*b*) with respect to said principal planes ($P_{21}$, $P_{22}$) of each of said lugs to thereby urge said lugs toward one another.

14. The clip of claim 12, wherein each said deformed zone (21*b*, 22*b*) includes two surfaces (21*e*, 21*f*, 22*d*, 22*f*) inclined with respect to said principal planes ($P_{21}$, $P_{22}$) and with respect to one another.

15. The clip of claim 14, wherein an apex angle ($\alpha$) of said deformed zones (21*b*, 22*b*) defined by said two inclined surfaces (21*e*, 21*f*, 22*e*, 22*f*) is included between 80° and 100°.

16. The clip of claim 15 wherein said apex angle ($\alpha$) is approximately 90°.

* * * * *